US005829965A

United States Patent [19]

Rubalcava

[11] Patent Number: 5,829,965

[45] Date of Patent: Nov. 3, 1998

[54] MULTIFUNCTION WAITER'S TOOL

[76] Inventor: Raul Rubalcava, 1318 E. 15th St., Santa Ana, Calif. 92701

[21] Appl. No.: 7,418

[22] Filed: Jan. 15, 1998

[51] Int. Cl.[6] ..... F23D 3/16

[52] U.S. Cl. ..... 431/253; 431/343; 7/151; 81/3.57

[58] Field of Search ..... 431/253, 343, 431/254; 81/3.57, 3.55, 3.09; 7/151, 167; 362/119, 120

[56] References Cited

U.S. PATENT DOCUMENTS

| | | | |
|---|---|---|---|
| 2,558,265 | 6/1951 | Mosch | 431/253 |
| 2,585,071 | 2/1952 | Allen | 431/253 |
| 2,691,287 | 10/1954 | Mosch | 431/253 |
| 4,569,653 | 2/1986 | Becker et al. | 431/253 |
| 4,642,827 | 2/1987 | Karuzas | 7/151 |
| 5,169,305 | 12/1992 | Kee | 431/253 |
| 5,653,525 | 8/1997 | Park | 431/253 |

*Primary Examiner*—James C. Yeung

[57] ABSTRACT

A new multifunction waiter's tool for combining functions of bottle opener, cigarette lighter, and bread crumb remover. The inventive device includes a handle portion. A bottle opener is pivotally coupled with the handle portion. A utility knife is pivotally coupled with the handle portion. A cork screw is pivotally coupled with the handle portion. A cigarette lighter is disposed within the handle portion opposite the utility knife. A bread crumb removing tool is slidably disposed within the handle portion.

4 Claims, 2 Drawing Sheets

MULTIFUNCTION WAITER'S TOOL

BACKGROUND OF THE INVENTION

1. Field of the Invention

The present invention relates to openers and lighters and more particularly pertains to a new multifunction waiter's tool for combining functions of bottle opener, cigarette lighter, and bread crumb remover.

2. Description of the Prior Art

The use of openers and lighters is known in the prior art. More specifically, openers and lighters heretofore devised and utilized are known to consist basically of familiar, expected and obvious structural configurations, notwithstanding the myriad of designs encompassed by the crowded prior art which have been developed for the fulfillment of countless objectives and requirements.

Known prior art openers and lighters include U.S. Pat. No. 4,642,827 to Karuzas; U.S. Pat. No. 4,923,392 to Moynihan, III; U.S. Pat. No. 5,169,305 to Kee; U.S. Pat. No. 4,437,359 to Dejoux et al.; U.S. Pat. No. 4,361,920 to Zanni; and U.S. Pat. No. Des. 294,449 to Kuhn.

While these devices fulfill their respective, particular objectives and requirements, the aforementioned patents do not disclose a new multifunction waiter's tool. The inventive device includes a handle portion. A bottle opener is pivotally coupled with the handle portion. A utility knife is pivotally coupled with the handle portion. A cork screw is pivotally coupled with the handle portion. A cigarette lighter is disposed within the handle portion opposite the utility knife. A bread crumb removing tool is slidably disposed within the handle portion.

In these respects, the multifunction waiter's tool according to the present invention substantially departs from the conventional concepts and designs of the prior art, and in so doing provides an apparatus primarily developed for the purpose of combining functions of bottle opener, cigarette lighter, and bread crumb remover.

SUMMARY OF THE INVENTION

In view of the foregoing disadvantages inherent in the known types of openers and lighters now present in the prior art, the present invention provides a new multifunction waiter's tool construction wherein the same can be utilized for combining functions of bottle opener, cigarette lighter, and bread crumb remover.

The general purpose of the present invention, which will be described subsequently in greater detail, is to provide a new multifunction waiter's tool apparatus and method which has many of the advantages of the openers and lighters mentioned heretofore and many novel features that result in a new multifunction waiter's tool which is not anticipated, rendered obvious, suggested, or even implied by any of the prior art openers and lighters, either alone or in any combination thereof.

To attain this, the present invention generally comprises a handle portion having a generally cylindrical configuration. The handle portion has opposed ends, a flat upper surface, a flat lower surface, and opposed curved side walls. The flat upper surface has an elongated recess formed therein. A bottle opener is pivotally coupled with one of the opposed ends of the handle portion. The bottle opener has a bifurcated interior end dimensioned for coupling with the handle portion. A utility knife is pivotally coupled with a slot formed in the opposed end of the handle portion adjacent to the bottle opener. A cork screw is pivotally coupled with the elongated recess of the handle portion. A cigarette lighter is disposed within one of the opposed ends of the handle portion opposite the utility knife. A bread crumb removing tool is slidably disposed within a slot formed inwardly of one of the opposed curved side walls of the handle portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multifunction waiter's tool apparatus and method which has many of the advantages of the openers and lighters mentioned heretofore and many novel features that result in a new multifunction waiter's tool which is not anticipated, rendered obvious, suggested, or even implied by any of the prior art openers and lighters, either alone or in any combination thereof.

It is another object of the present invention to provide a new multifunction waiter's tool which may be easily and efficiently manufactured and marketed.

It is a further object of the present invention to provide a new multifunction waiter's tool which is of a durable and reliable construction.

An even further object of the present invention is to provide a new multifunction waiter's tool which is susceptible of a low cost of manufacture with regard to both materials and labor, and which accordingly is then susceptible of low prices of sale to the consuming public, thereby making such multifunction waiter's tool economically available to the buying public.

Still yet another object of the present invention is to provide a new multifunction waiter's tool which provides in the apparatuses and methods of the prior art some of the advantages thereof, while simultaneously overcoming some of the disadvantages normally associated therewith.

Still another object of the present invention is to provide a new multifunction waiter's tool for combining functions of bottle opener, cigarette lighter, and bread crumb remover.

Yet another object of the present invention is to provide a new multifunction waiter's tool which includes a handle portion. A bottle opener is pivotally coupled with the handle portion. A utility knife is pivotally coupled with the handle portion. A cork screw is pivotally coupled with the handle portion. A cigarette lighter is disposed within the handle portion opposite the utility knife. A bread crumb removing tool is slidably disposed within the handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
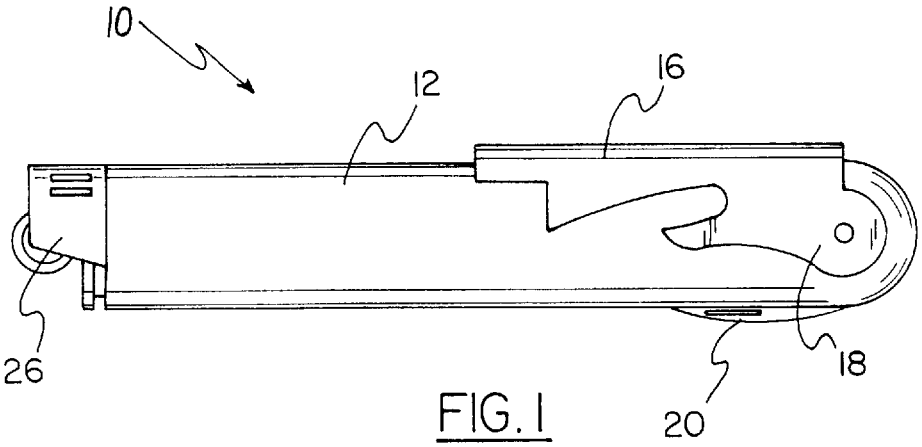
FIG. 1 is a side view of a new multifunction waiter's tool according to the present invention.
Figure 2:
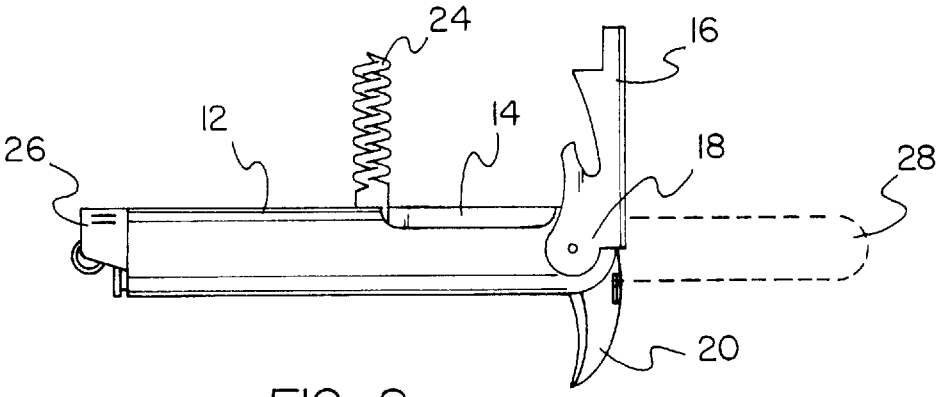
FIG. 2 is a side view of the present invention illustrated in an extended orientation.
Figure 3:
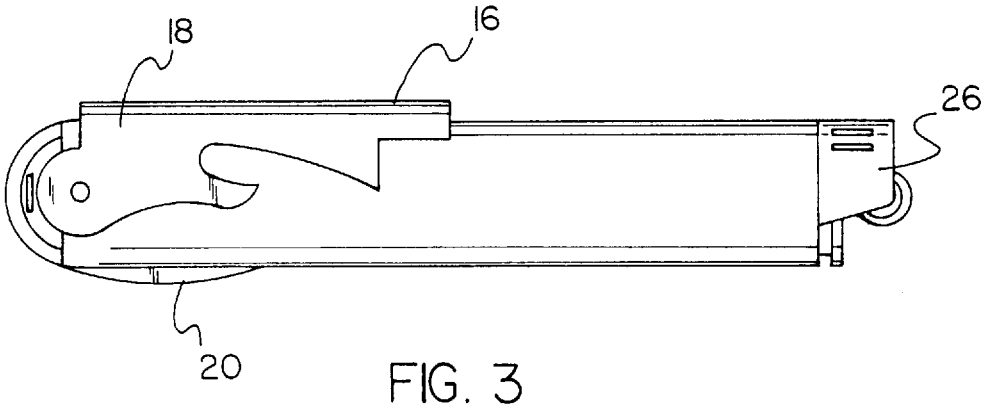
FIG. 3 is an alternate side view of the present invention.
Figure 4:
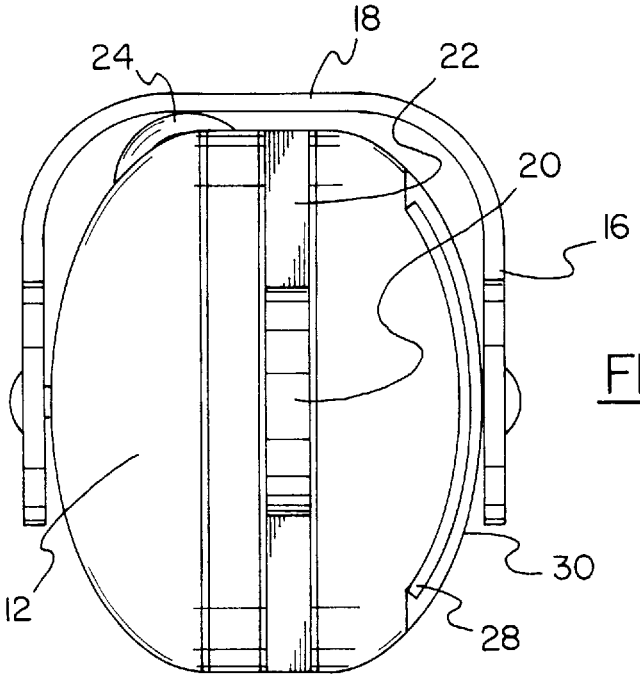
FIG. 4 is one end view of the present invention.
Figure 5:
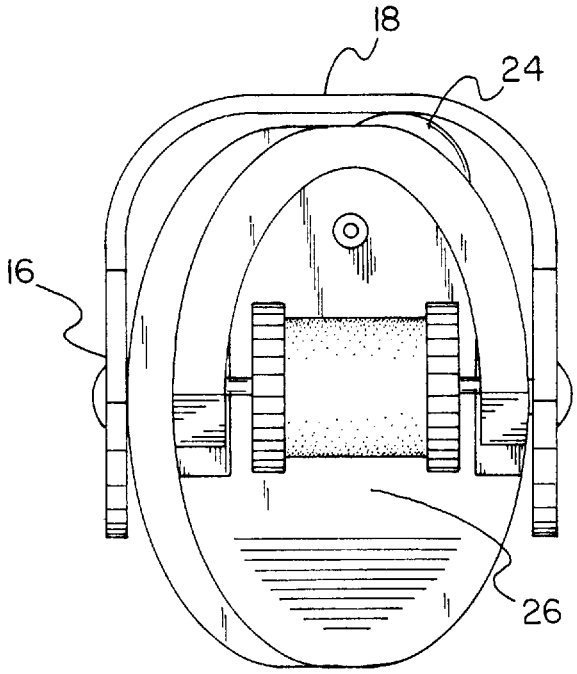
FIG. 5 is another end view of the present invention.

With reference now to the drawings, and in particular to FIGS. 1 through 5 thereof, a new multifunction waiter's tool embodying the principles and concepts of the present invention and generally designated by the reference numeral 10 will be described.

As best illustrated in FIGS. 1 through 5, the multifunction waiter's tool 10 comprises a handle portion 12 having a generally cylindrical configuration. The handle portion 12 has opposed ends, a flat upper surface, a flat lower surface, and opposed curved side walls. The flat upper surface has an elongated recess 14 formed therein.

A bottle opener 16 is pivotally coupled with one of the opposed ends of the handle portion 12. The bottle opener 16 has a bifurcated interior end 18 dimensioned for coupling with the handle portion.

A utility knife 20 is pivotally coupled with a slot 22 formed in the opposed end of the handle portion 12 adjacent to the bottle opener 16. The utility knife 20 is used to cut off plastic labels that cover wine bottles prior to their opening.

A cork screw 24 is pivotally coupled with the elongated recess 14 of the handle portion 12.

A cigarette lighter 26 is disposed within one of the opposed ends of the handle portion 12 opposite the utility knife 20.

A bread crumb removing tool 28 is slidably disposed within a slot 30 formed inwardly of one of the opposed curved side walls of the handle portion 12.

In use, the present invention would combine the functions of a cigarette lighter 26, crumb remover 28, and wine bottle opener 24 in one unit. With the present invention, a server could scrape a table, light a cigarette, open a wine bottle, and open a beer bottle with one product.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new multifunction waiter's tool for combining functions of a bottle opener, cigarette lighter, and bread crumb remover comprising, in combination:

a handle portion having a generally cylindrical configuration, the handle portion having opposed ends, a flat upper surface, a flat lower surface, and opposed curved side walls, the flat upper surface having an elongated recess formed therein;

a bottle opener pivotally coupled with one of the opposed ends of the handle portion, the bottle opener having a bifurcated interior end dimensioned for coupling with the handle portion;

a utility knife pivotally coupled with a slot formed in the opposed end of the handle portion adjacent to the bottle opener;

a cork screw pivotally coupled with the elongated recess of the handle portion;

a cigarette lighter disposed within one of the opposed ends of the handle portion opposite the utility knife; and a bread crumb removing tool slidably disposed within a slot formed inwardly of one of the opposed curved side walls of the handle portion.

2. A new multifunction waiter's tool for combining functions of a bottle opener, cigarette lighter, and bread crumb remover comprising, in combination:

a handle portion;

a bottle opener pivotally coupled with the handle portion;

a utility knife pivotally coupled with the handle portion;

a cork screw pivotally coupled with the handle portion;

a cigarette lighter disposed within the handle portion opposite the utility knife; and a bread crumb removing tool slidably disposed within the handle portion.

3. The multifunction waiter's tool as set forth in claim 2 wherein the handle portion has opposed ends, a flat upper surface, a flat lower surface, and opposed curved side walls.

4. The multifunction waiter's tool as set forth in claim 2 wherein the bottle opener has a bifurcated interior end dimensioned for coupling with the handle portion.

* * * * *